United States Patent [19]

Nakao et al.

[11] Patent Number: 4,775,254

[45] Date of Patent: Oct. 4, 1988

[54] LINING METHOD AND APPARATUS FOR PRINTERS

[75] Inventors: Fumio Nakao, Kawasaki; Kaneatsu Uchiyama, Hachioji; Takashi Maekawa, Machida; Mitsugu Inomata, Kawasaki; Tetsu Endo, Komae, all of Japan

[73] Assignee: Fujitsu Limited, Kawaski, Japan

[21] Appl. No.: 928,361

[22] Filed: Nov. 10, 1986

[30] Foreign Application Priority Data

Nov. 9, 1985 [JP] Japan ..... 60-249939

[51] Int. Cl.[4] ..... B41J 13/16

[52] U.S. Cl. ..... 400/279; 400/568; 400/708; 400/619

[58] Field of Search ..... 400/568, 279, 708, 611, 400/619, 624, 625, 629

[56] References Cited

U.S. PATENT DOCUMENTS

| | | | |
|---|---|---|---|
| 4,062,436 | 12/1977 | Kondur | 400/124 |
| 4,326,815 | 4/1982 | Kapp | 400/629 X |
| 4,647,239 | 3/1987 | Maezawa | 400/708 |

*Primary Examiner*—Paul T. Sewell

*Attorney, Agent, or Firm*—Staas & Halsey

[57] ABSTRACT

In a method and apparatus for changing the line of a sheet to be printed, the sheet is set in a print starting position, in which a front end of the sheet is located in front of bail rollers which feed the sheet together with a platen, and a carriage with a print head and a sheet guide is moved to a predetermined guide position in which the sheet guide is located at or near the center of width of the sheet, prior to every change of line, until the front end of the sheet is held between the bail rollers and the platen.

6 Claims, 7 Drawing Sheets

| |
|---|
| Fig. 5A |
| Fig. 5B |

LINING METHOD AND APPARATUS FOR PRINTERS

BACKGROUND OF THE INVENTION

1. Field of the Invention

The present invention relates to a method and apparatus for changing the line in a printer, in particular in a serial printer.

The present invention can be applied to the printing of both cut sheets and continuous sheets with perforations on each side of the sheet. These continuous sheets will be referred to hereinafter as fanfold paper.

In a serial printer which prints, for example, a cut sheet, after the cut sheet is loaded on a rear cover of the printer, the sheet is fed forward in accordance with a command to start printing from a line change drive control unit, so that a platen rotates to move the sheet with the help of pinch rollers. During the movement of the sheet, the sheet is sensed by a sensor, which is located on the passageway of the sheet to detect passing of the front end of the sheet.

A further movement of the sheet is carried out through a predetermined displacement from the point of the detection to bring the sheet to a print starting position, at which the printing is commenced. The sheet set at the print starting position is printed by a printing head carried on a carriage which moves along the platen. The sheet is fed forward line by line by the rotation of the platen.

2. Description of the Related Art

Generally, when the sheet is located in the print starting position, the front end of the sheet is held between the platen and bail rollers which, together with the rotating platen, feed the sheet forward.

Namely, there is a vacant space at the front end (leading end) of the sheet, corresponding to a distance L between the front edge of the sheet and the portion of the sheet that is located in front of the printing head. That is, when the sheet is located at the print starting position, the front edge of the sheet passes the printing head by the distance L. Therefore, when the printing is completed for one sheet, there is always a vacant space (non-printed area) corresponding to the distance L at the front end of the sheet.

On the contrary, if the printing is commenced immediately the front edge of the sheet reaches the printing head, often the front end of the sheet is not held between the bail rollers and the platen when the front end of the sheet reaches the bail rollers during the forward movement of the sheet. This results in a paper jam.

SUMMARY OF THE INVENTION

The primary object of the present invention is to eliminate the drawbacks mentioned above and make it possible to carry out printing even on the front edge of the sheet, before the front edge of the sheet reaches the bail rollers, while ensuring that the front end of the sheet can be firmly held between the bail rollers and the platen when the front end reaches the bail rollers, without the possibility of a paper jam.

In order to achieve the object mentioned above, according to the present invention, there is provided in a printer having a platen which rotates about its own axis to feed a sheet to be printed, a carriage which moves along the axis of the platen and which has a printing head and a sheet guide integral therewith to guide the movement of the sheet along the platen, and bail rollers which hold, between the bail rollers and the platen, the sheet when it has moved past the printing head, a method for changing the line of the sheet comprising setting the sheet in a print starting position, in which a front end of the sheet is located in front of the bail rollers, and moving the carriage to a predetermined guide position in which the sheet guide is located at or near the center of the width of the sheet, prior to every change of line, until the front end of the sheet is held between the bail rollers and the platen.

According to another aspect of the invention, an apparatus for changing the line of the sheet comprises means for setting the sheet in a print starting position, in which a front end of the sheet is located in front of the bail rollers, and means for moving the carriage to a predetermined guide position in which the sheet guide is located at or near the center of the width of the sheet, prior to every change of line, until the front end of the sheet is held between the bail rollers and the platen.

According to still another aspect of the invention, there is provided in a printer having a platen which rotates about its own axis to feed a sheet to be printed, a carriage which moves along the axis of the platen and which has a printing head and a sheet guide integral therewith to guide the movement of the sheet along the platen, bail rollers which hold, between the bail rollers and the platen, the sheet when it has moved past the printing head, and a sheet sensor which detects the presence of the sheet, said sheet being set in a print starting position in which the front end of the sheet is located in front of the bail rollers, an apparatus for changing the line of the sheet comprising means for counting accumulated number (M) of lines from the detection by said sensor, means for storing a set number (L) of lines, means for comparing the accumulated number (M) and the set number (L), means for storing a predetermined guide position (S) of the carriage in the direction of the movement thereof, means for determining whether the movement of the carriage is necessary or not, with reference to the result of a comparison at each command for change of a line, means for moving the carriage with the sheet guide to the guide position (S), in response to the determination of the determining means, and means for rotating the platen to feed the sheet by a predetermined amount of displacement when the carriage is moved to the guide position or when movement of the carriage is not necessary.

With the arrangement of the invention mentioned above, the sheet to be printed is set in the print starting position, so that the front end thereof can be located in front of the printing head, upstream of the bail rollers, namely the front end does not reach the bail rollers at the beginning of printing. The carriage is always moved to a predetermined guide position in which the sheet guide on the carriage guides the movement of the sheet along the platen so as to feed the front end of the sheet between the bail rollers and the platen, prior to each change of a line of the sheet. Namely, when a line change command is given, the carriage is moved to the guide position in which the sheet guide is at or near the center of the width of the sheet, before the line change is carried out.

This prior movement of the carriage takes place only until the front end of the sheet is located between the bail rollers and the platen.

The movement of the sheet guide of the carriage to the guide position prior to each change of the line ensures that the front end of the sheet is fed between the bail rollers and the platen step by step.

This results in the prevention of a paper jam which would otherwise take place because of a failure to squeeze the front end of the sheet into a slight gap between the bail rollers and the platen.

BRIEF DESCRIPTION OF THE DRAWINGS

The invention will be described below in detail with reference to the accompanying drawings, in which.

DESCRIPTION OF THE PREFERRED EMBODIMENTS

Figure 1:
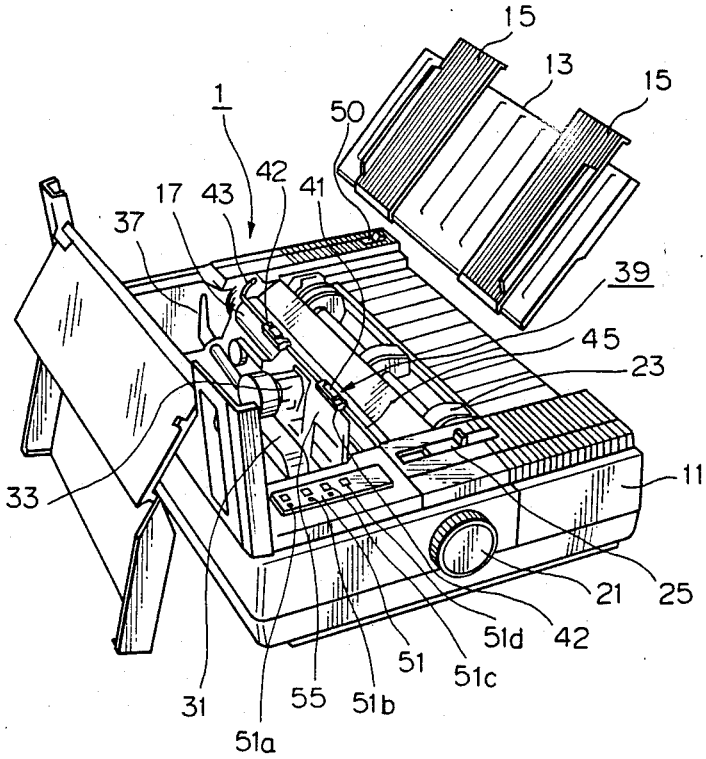
FIG. 1 is a perspective view of a serial printer to which the present invention is applied.

In FIG. 1, the serial printer 1 has a printer body 11 on which a rear cover 13 is detachably mounted. The rear cover 13 is provided with adjustable guides 15 which can be moved close to and away from each other to adjust the space therebetween in accordance with the width of a sheet 10 (FIG. 2) to be printed. A cylindrical platen 17, which is rotatably supported in the body 11, supports the sheet 10 while printing is carried out. The platen 17 can be manually rotated by a platen knob 21 to manually feed the sheet, if necessary. The rear cover 13 is used to load cut sheets of paper and guide fanfold paper (continuous sheets).

Sheet tractors (sprockets) 23 are rotatably supported in the body 11 holds and feed the fanfold paper. The sheet tractors 23 operate only when the fanfold paper is to be printed. The paper feed mode can be changed by a paper release lever 25 which can occupy two positions, i.e. a friction position in which pinch rollers 35 (FIG. 4) are pressed against the platen 17 so as to feed cut sheets between the pinch rollers 35 and the platen 17 and a release position in which the pinch rollers 35 are moved away from the platen, as designated by an imaginary line 35' in FIG. 4 and in which the sheet tractor 23 can rotate.

A carriage 31 is mounted to the printer body 11 so as to move along the axis of the platen 17, namely in the direction perpendicular to the direction of feed of the sheet 10. The carriage 31 has a printing head 33 which prints on the sheet 10. The gap between the printing head 33 and the platen 17 can be changed by a paper thickness level 37, in accordance with the thickness of the sheet 10. The sheet 10 printed by the printing head 33 is held by bail roller units 39, each having a rotatable bail roller 41 and a roller holder 42 (FIGS. 1 and 7), against the platen 17. Each bail roller unit 39 can move along and on a bail shaft 45 which extends parallel to the axis of the platen 17.

The bail roller units 39 and the bail shaft 45 can be moved away from the platen 17 by a bail lever 43, as is well known.

The numeral 50 designates a power switch of the printer 1. An operator panel 51 is provided with lamps, such as a power lamp 51*a* and an ON LINE lamp 51*b* (which lights when the printer is ON LINE with a host computer 110), etc., and switches, such as an ON LINE switch 51*c* for setting an ON LINE or OFF LINE mode, and a sheet set switch (starter switch) 51*d*, etc.

The illustrated mechanical construction of the serial printer per se is typical and is well known. Accordingly a further detailed explanation is omitted.

Figure 7:
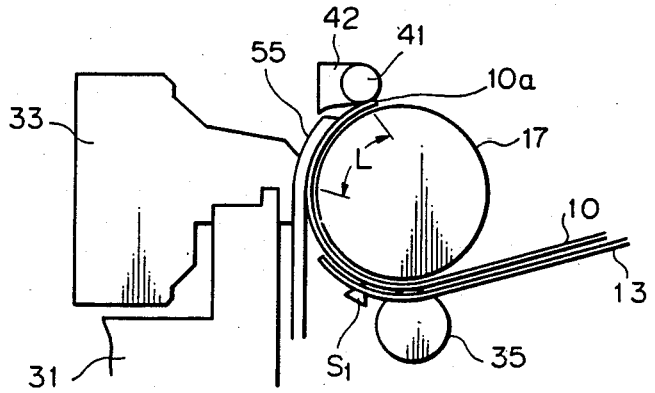
Fig. 7 (PRIOR ART)
FIG. 7 is a schematic view similar to FIG. 2 but showing the prior art.
Figure 8:
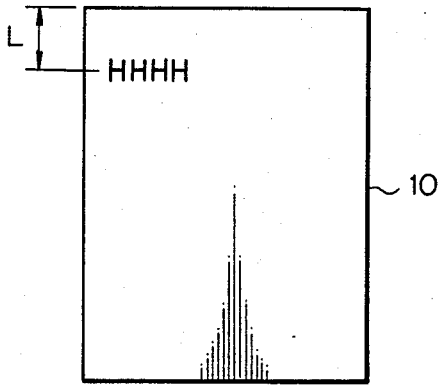
Fig. 8 (PRIOR ART)
FIG. 8 is a plan view of a cut sheet which has a vacant space at the top end thereof, according to the prior art; and, FIG. 9 is a view similar to FIG. 3 but showing the occurrence of paper jam, according to the prior art.
Figure 9:
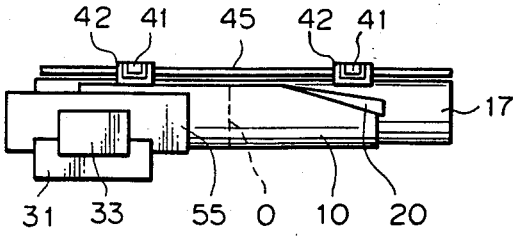
Fig. 9 (PRIOR ART)

In a conventional printer, as shown in FIGS. 7, 8, and 9, the cut sheet 10 is loaded on the rear cover 13 and is inserted between the platen 17 and the pinch rollers 35. The insertion of the sheet 10 in the printer 1 continues until the front end 10*a* of the sheet 10 is held between the platen 17 and the bail rollers 35. In other words, setting of the sheet at the print starting position is completed when the front end 10*a* of the sheet 10 is held between the bail rollers 35 and the platen 17, as shown in FIG. 7. After the sheet 10 is set in the print starting position in which the front end 10*a* of the sheet is held by the bail rollers 35 against the platen 17, printing of the sheet can commence. As can be seen from the foregoing, when the sheet 10 is set in the print starting position, the front end 10*a* of the sheet 10 has moved past the printing head 33 by a distance L, which corresponds to the distance between the bail rollers 35 and the printing head 33 (exactly speaking, the print center of the printing head 33). Namely, the sheet 10 after printing always has a non-printed area (vacant space) defined by the distance L, at the top of the sheet 10, as shown in FIG. 8. This non-printed area decreases the printing density.

On the other hand, if printing is commenced as soon as the front end 10*a* of the sheet 10 reaches the printing head 33, so that there is no vacant space at the top of the sheet, the front end 10*a* of the sheet 10 tends not to be inserted between the bail rollers 41 and the platen 17 when the front end 10*a* reaches that point, thus resulting in the occurrence of paper jam, as designated by the numeral 20 in FIG. 9. This paper jam occurs particularly when the line change takes place when the carriage 31 with the sheet guide 55 is far off the center 0 of the width of the sheet 10, as shown in FIG. 9.

In FIG. 7, $S_1$ designates a sheet sensor which detects a passing of the front end 10*a* of the sheet 10 therethrough.

The present invention aims at enabling the commencement of printing of the sheet 10 from the leading edge of the sheet 10 without producing an undesirable vacant space at the leading end 10*a* thereof, and without inviting a paper jam when the leading edge of the sheet 10 reaches the bail rollers 41.

Figure 2:
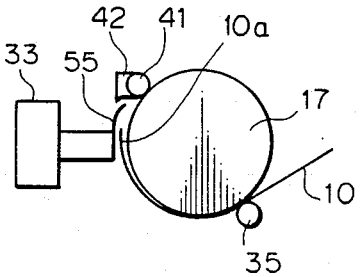
FIG. 2 is a schematic view of main parts of the printer shown in FIG. 1, for explaining how to change the line of the sheet, according to the present invention.
Figure 3:
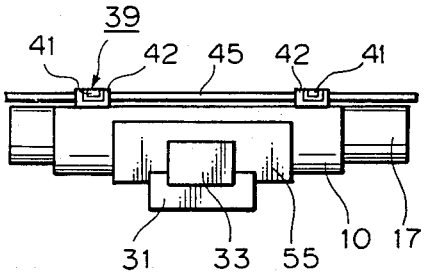
FIG. 3 is a front elevational view of the arrangement illustrated in FIG. 2.

In summary, according to the present invention, printing of the sheet 10 can be commenced, as soon as the front end 10*a* of the sheet reaches the printing head 33, as can be seen from FIG. 2, and the carriage 31 with the sheet guide 55 is always brought to a predetermined guide position on or near the center of the width of the sheet 10 before the line changing is carried out, until the front end 10*a* of the sheet 10 is held between the bail rollers 41 and the platen 17, as shown in FIG. 3. Since the line changing is always effected with the sheet guide located at the guide position, the front end 10*a* of the sheet 10 can be inserted between the bail rollers 41 and the platen 17 while being guided by the sheet guide 55, without an occurrence of a paper jam.

Figure 4:
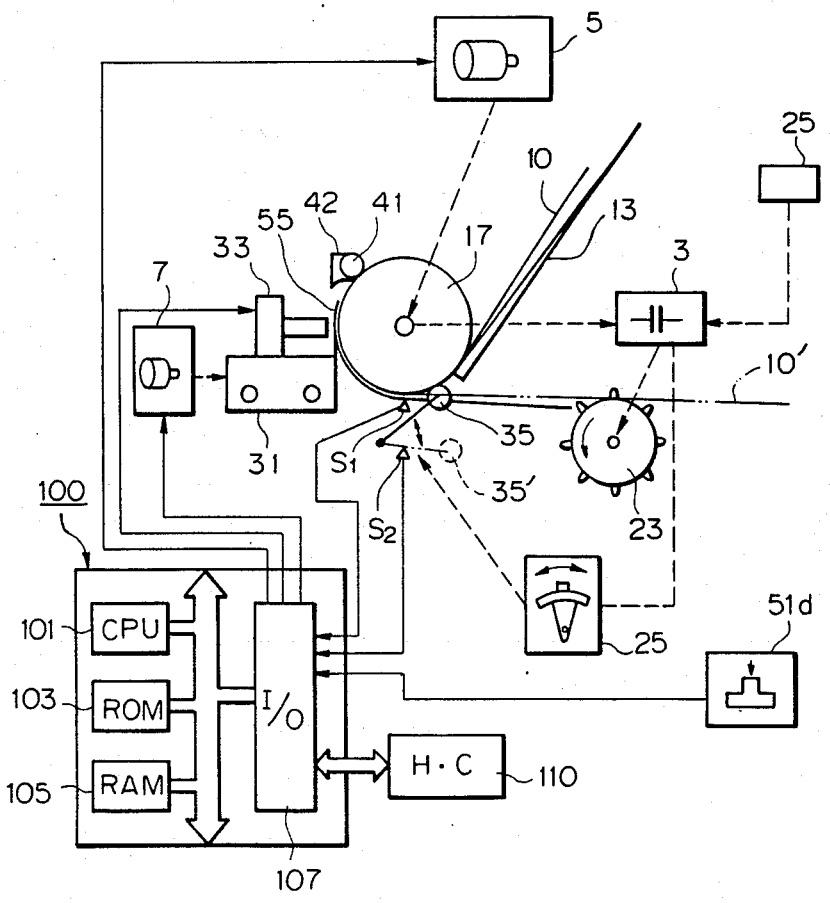
FIG. 4 is a block diagram of a printer shown in FIG. 1.

In FIG. 4, the numeral 3 designates a clutch which operates in response to the operation of the paper release lever 25 to rotate the sheet tractors 23 when the continuous sheet 10' (fanfold paper) is loaded. As mentioned before, the pinch rollers 35 come away from the platen 17, so that the pinch rollers 35 do not interfere with the movement of the fanfold paper 10', when the paper release lever 25 is operated.

The sheet tractors 23 can be rotated by a first motor 5 referred to hereinafter as a line changing motor, through the clutch 3. The first motor 5 also rotates the platen 17 in accordance with line change commands from a control unit 100, which will be described hereinafter. A sensor $S_2$ detects whether the paper release lever 25 is in the friction position or in the release position to detect whether the sheets are cut sheets 10 or fanfold paper 10'. The sheet tractors 23 do not rotate when the cut sheets 10 are loaded in the printer 1. The numeral 7 designates a second motor, referred to hereinafter as a space motor, which moves the carriage 31 and, accordingly, the printing head 33, in a direction parallel to the axis of the platen 17.

The control unit 100 has a central processing unit (CPU) 101, a read only memory (ROM) 103 which stores programs, constants and the like, a random access memory (RAM) 105 which stores temporary data, and an input/output interface (I/O) 107 which is connected to the host computer 110, the sensors $S_1$ and $S_2$, the motors 5 and 7, the printing head 31, and the sheet set switch 51*d*, etc.

Figure 6A:
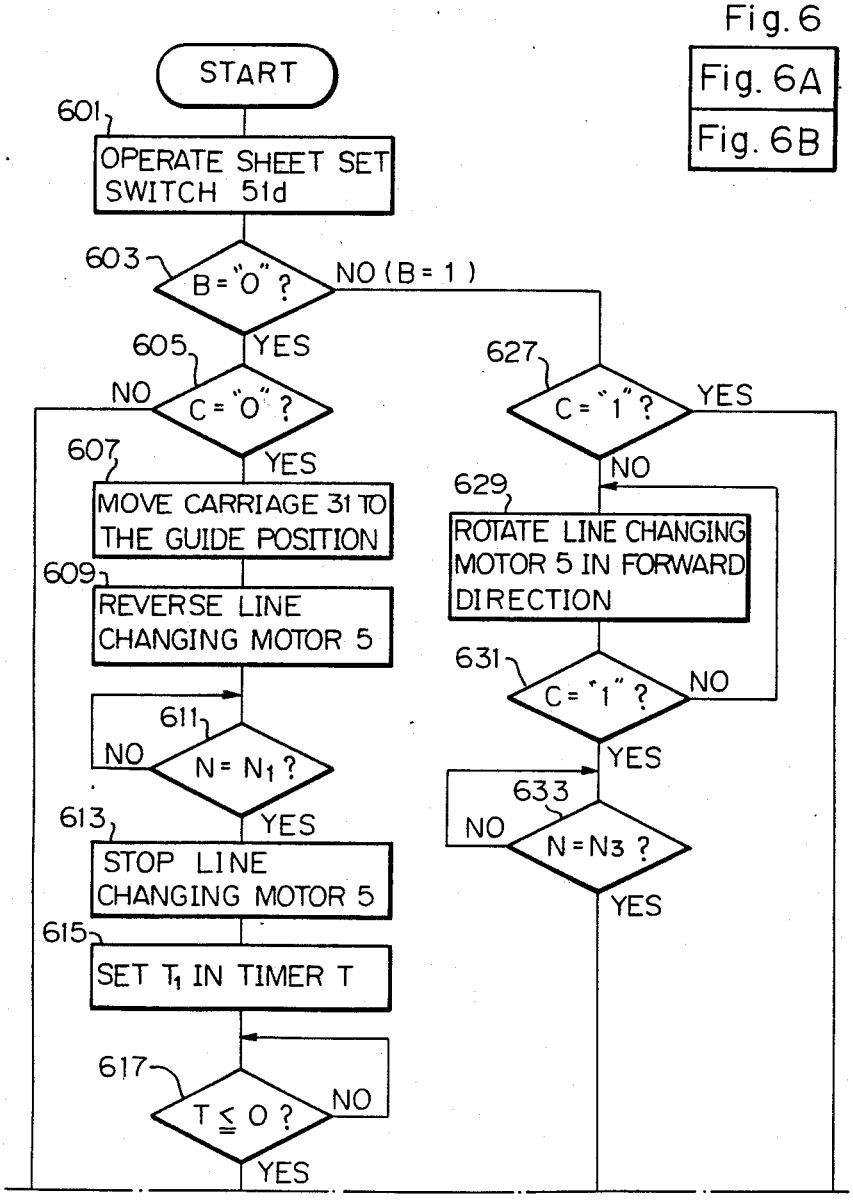
FIG. 6 (FIGS. 6A and 6B) is a flow chart showing the steps for printing, according to the present invention.
Figure 6B:
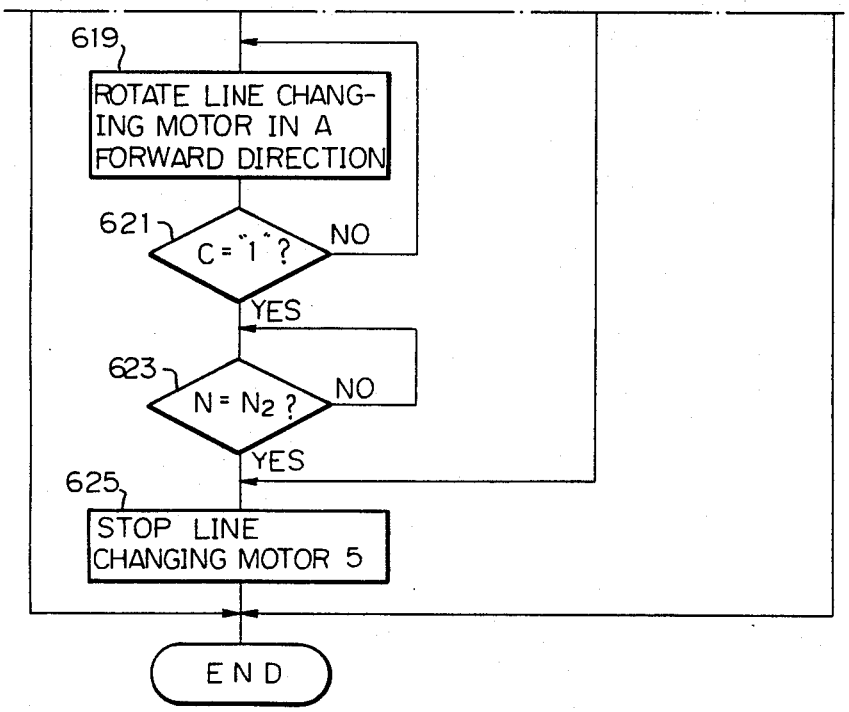

In FIG. 6 which shows how the cut sheet 10 is set in the print starting position according to the present invention, B="0" shows the detection of the friction position of the paper release lever 25 by the second sensor $S_2$;

B="1" shows the detection of the release position of the lever 25 by the second sensor $S_2$;

C="0" shows the detection of the absence of the sheet 10 in front of the sensor $S_1$, by the first sensor $S_1$; and, C="1" shows the detection of the presence of the sheet 10 in front of the sensor $S_1$ by the sensor $S_1$.

First, the cut sheet 10 is loaded on the rear cover 13 and the sheet set switch 51*d* is pressed, at step 601, and then whether the paper release lever 25 is in the friction position or in the release position is detected by the second sensor $S_2$ (FIG. 4).

The detection is confirmed in the control unit 100.

When the friction position of the lever 25 is detected at step 603 (namely, B=0), the absence of the cut sheet 10 in front of the sensor $S_1$ is then detected by the first sensor $S_1$ at step 605. After the absence of the cut sheet 10 in front of the sensor $S_1$ is detected (i.e. C=0), the carriage 31 is moved to the predetermined guide position at or near the center of the width of the cut sheet 10 to be printed, at step 607. This movement will be referred to hereinafter as "centering" of the carriage. When the centering of the carriage is finished, the line changing motor 5 is reversed at step 609. The centering of the carriage 31 ensures that the sheet 10 can be guided by the sheet guide 55 integral with the carriage 31 along the platen 17 and between the bail rollers 41 and the platen 17, which will be described in detail hereinafter. The reverse rotation of the line changing motor 5, which causes the reverse rotation of the platen 17, contributes to a correction of the posture of the sheet 10. Namely, even if the sheet is inclined with respect to the direction of the feed thereof, the inclination can be corrected by a slight reverse movement of the sheet 10 due to the reverse of the platen 17. Thus, the wrong posture of the sheet is corrected before it is fed between the pinch rollers 35 and the platen 17. Note, step 609 can be dispensed with. The reverse rotation of the platen 17 continues until the amount N of reverse rotation is a predetermined value N1. When the amount N is detected to be N1, at step 611, the line changing motor 5 stops rotating to stop the platen 17, at step 613. The platen 17 remains stopped for a predetermined time $T_1$. To this end, the time $T_1$ is set in a timer T which is counted down by one at predetermined time intervals, at step 615. At step 617, T is detected to be the set value $T_1$, namely $T_1 \leqq 0$. When T is zero or a minus value, the platen 17 is rotated in the forward direction again by the forward rotation of the line changing motor 5, at step 619. The forward rotation of the platen 17 continues for a predetermined amount of rotation.

Namely, the rotation of the platen 17 continues until the amount N of rotation thereof after the detection of the passing of the front end 10*a* of the sheet 10 by the sensor $S_1$ at step 621 is a predetermined value of N2. When the amount N is detected to be N2 at step 623, the line changing motor 5 is stopped to stop the rotation of the platen 17 at step 625. At this stage, the sheet 10 is set in the print starting position.

At step 603, if the sensor $S_2$ detects the release position of the lever 25 (B=1), in which the pinch rollers 35 are away from the platen as shown by the imaginary line 35' in FIG. 4, and the sheet tractors (sprockets) 23 can be rotated by the line changing motor 5 through the clutch 3; namely, if the fanfold paper 10' is loaded in the printer 1, the flow chart goes to step 627, in which the first sensor $S_1$ detects the absence of the sheet 10 in front of the sensor $S_1$.

After the absence of the sheet 10 in front of the sensor $S_1$ is detected, the line changing motor 5 rotates to drive the platen 17 in the forward direction at step 629. When the platen 17 rotates, the sheet tractors 23 rotate together with the platen 17, so that the fanfold paper 10' can be fed forward while being guided by the sheet guide 55.

The rotation of the platen 17, and accordingly, the paper tractors 23, continues until the amount N of rotation thereof after the detection of passing of the front end of the sheet 10' by the sensor $S_1$ at step 631 is a predetermined value N3. When the sheet 10' is fed to the print starting position by the rotation of the line changing motor 5 by a value N3, the line changing motor 5 stops rotating at step 625.

It should be noted that the roller holders 42 define a part of the passageway of the sheet 10 or 10'. Namely, the roller holders 42 prevent the portion of the sheet 10 that has passed the sheet guide 55 from coming out of the passageway. If the roller holders 42 are not provided, the sheet 10 that has passed the sheet guide may not be brought between the bail rollers 41, and the platen 17.

In the foregoing discussion the platen 17 is reversed once before the sheet 10 is fed forward. Alternatively, it is also possible to repeat the forward and reverse rotation of the platen 17, so that the reversing of the platen 17 takes place intermittently. This intermittent reverse motion is particularly useful for correcting inclination of the sheet 10 prior to the feed of the sheet 10 into the printing position, due to vibration by the intermittent reverse, where the inclination can not be corrected by only one reverse rotation of the platen 17, depending on the material, thickness or size of the sheet 10 to be loaded in the printer 1. The stopping of the platen 17 for a predetermined period between the forward rotation and the reverse rotation of the platen 17 (corresponding to steps 615 and 617) can be dispensed with. Namely, the platen 17 can be rotated in the forward direction immediately after the stopping of the reverse motion of the platen 17, without a predetermined pause.

At step 627, if the sensor $S_1$ detects the presence of the sheet in front of the sensor $S_1$ (i.e. $C=1$), setting of the sheet 10 is not necessary.

After the sheet 10 is set in the print starting position as mentioned above, the carriage 31 is moved along the axis of the platen 17 by the spacing motor 7 and the printing head 33 is operated in accordance with printing programs from the host computer 110 to carry out the printing.

During printing, the line change is effected by the operation of the line changing motor 5, similar to the conventional printing operation.

In the print starting position, the front end 10*a* of the sheet 10 has not yet reached the bail rollers 41, in the present invention.

Figures 5, 5A:
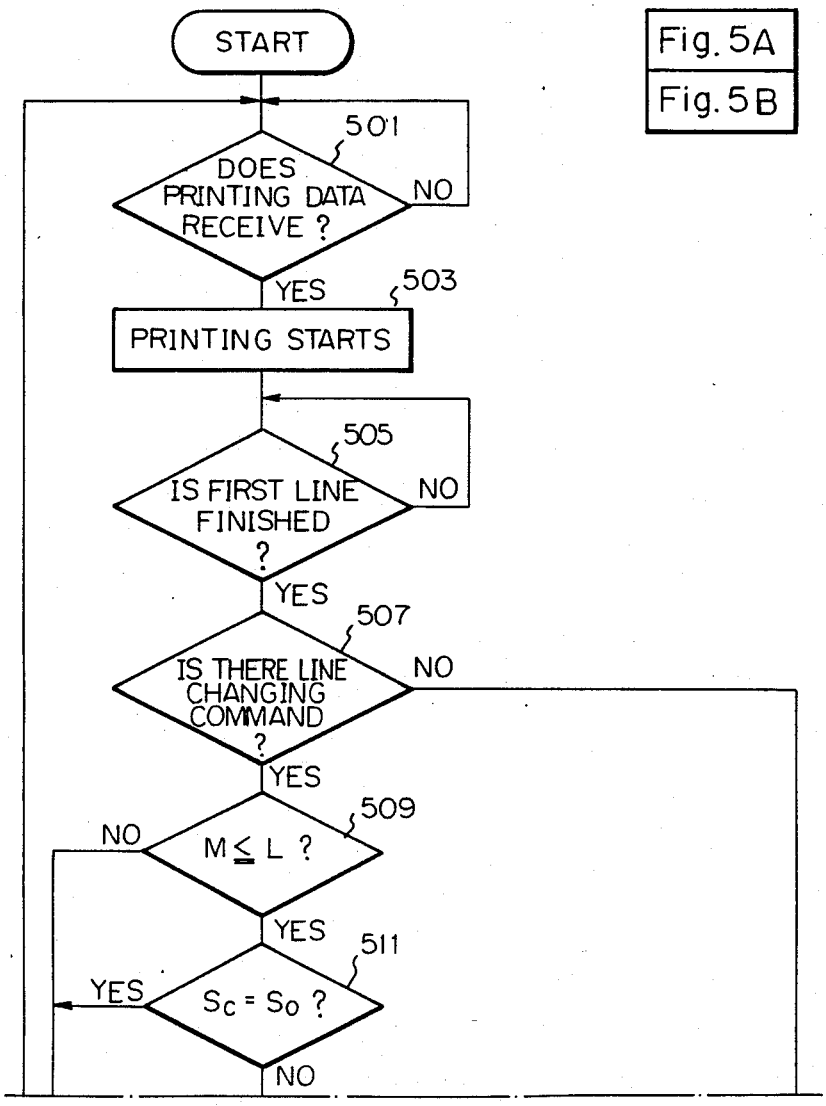
FIG. 5 (FIGS. 5A and 5B) is a flow chart showing the steps for the change of line, according to the present invention.
Figure 5B:
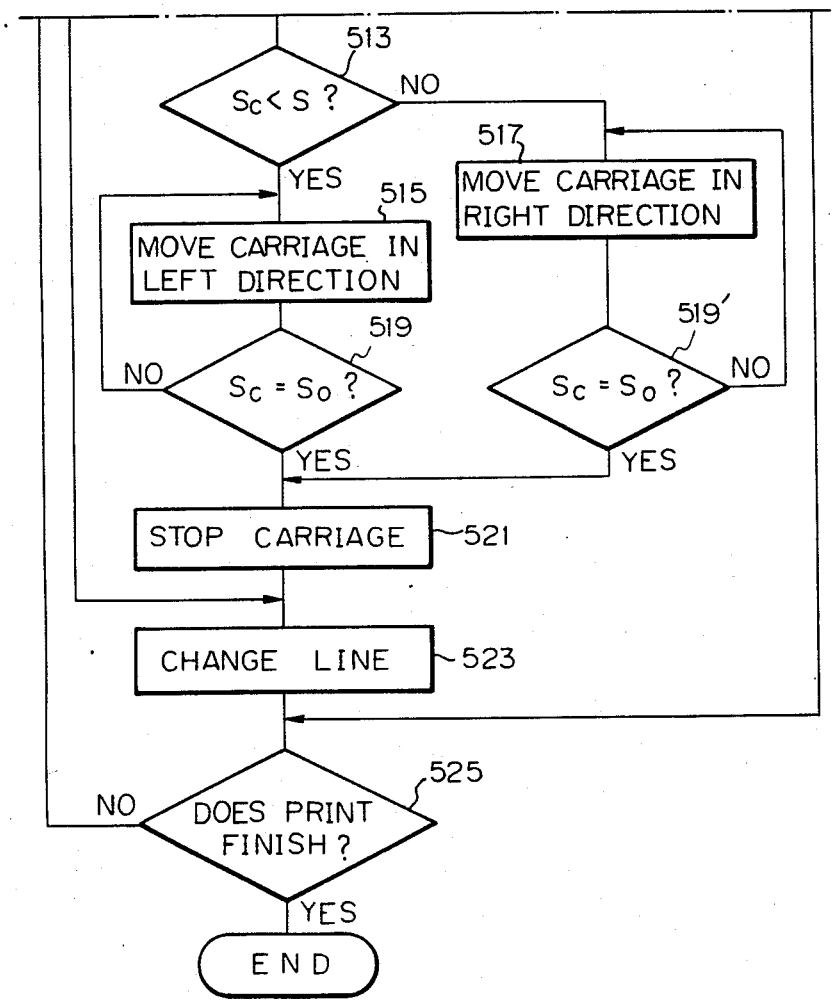

FIG. 5 shows a flow chart of line changing steps before the front end 10*a* of the sheet 10 reaches the bail rollers 41, according to the present invention.

In the present invention, the front end 10*a* of the sheet 10 is located directly in front of the printing head 33 upstream of the bail rollers 41, at the print starting position.

In FIG. 5, when printing data is input to the printer from the host computer 110, at step 501, the printing starts at step 503. At step 501, if printing data is not received, printing does not start. Then, after the completion of printing of the first line is detected at step 505, the line changing is effected in accordance with line change commands. At step 507, whether or not a line change command has been sent is detected. When a line change command has not been sent, namely when a line change is not necessary, the printing is finished. When the line change command is detected at step 507, the accumulated number (M) of lines is compared with a predetermined number (L) of lines which is stored in ROM 103 in the control unit 100, to detect whether or not the sheet 10 should be guided by the sheet guide 55. When $M \leqq L$ is detected at step 509, namely, when the guiding of the sheet 10 by the sheet guide 55 is determined at step 509, the present position of the carriage 31, and accordingly, of the sheet guide 55 10 is calculated. Then, the present position Sc of the carriage 31 is compared with a predetermined guide position So of the carriage 31 stored in the ROM 103, at step 511. The guide position So is predetermined so that the sheet guide 55 is located on or near the center of the width of the sheet 10. This sheet guide position So generally corresponds to the center of the platen 17 in the direction of the axis thereof but may be deviated therefrom, for example when the printing head 33 is not positioned at the center of the sheet guide 55, that is the sheet guide 55 is offset from the center of the printing head 33 in the direction of the axis of the platen 17.

If the carriage 31 happens to be in the guide position So ($Sc=So$), movement of the carriage is not necessary, and accordingly, line changing is immediately carried out at step 523.

If the present position Sc of the carriage 31 is not in the guide position So at step 511 ($Sc \neq So$), whether the present position Sc is on the right or left of the guide position So is detected at step 513.

In accordance with the detection of the present position at step 513, the carriage 31 is moved in either the left or right direction along the platen 17.

For example, when the carriage 31 is offset from the guide position in the right direction, the carriage 31 is moved in the left direction until the carriage 31 comes to the guide position So, at step 515.

On the other hand, when the carriage 31 is offset from the guide position in the left direction, the carriage 31 is moved in the right direction at step 517, until the carriage 31 comes to the guide position.

The movement of the carriage 31 can be effected by the spacing motor 7 (FIG. 4). When the carriage 31 reaches the guide position (i.e. $Sc=So$) at step 519 or 519', the carriage 31 is stopped, at step 521. After that, the line changing is carried out, at step 523. It will be appreciated that when the line changing is carried out, the carriage 31 is brought into the guide position prior to the movement of the carriage 31, so that the sheet guide 55 is at or near the center of the width of the sheet 10, and accordingly, the sheet 10 can be guided by the sheet guide 55 during line changing. This prevents a paper jam which would otherwise take place, since the front end 10*a* of the sheet 10 has not yet reached the bail rollers 41.

After the line is changed, a programmed printing is carried out.

The steps mentioned above are repeated until the printing is completely finished, which is detected at step 525.

During further line changing, the accumulated number M of the lines exceeds the predetermined value L at step 509. When $M>L$ at step 509, the front end 10*a* of the sheet 10 reaches the bail rollers 41 and is held by and between the bail rollers 41 and the platen 17 with the help of the sheet guide 55, as mentioned before. Namely, when the front end 10*a* of the sheet is held between the platen 17 and the bail rollers 41, centering of the carriage 31 is not necessary, and accordingly, line changing can be immediately carried out, at step 523, without moving the carriage 31 to the guide position. That is, when $M>L$ at step 509, the process skips from step 509 to step 523. This skip occurs also when the carriage 31 happens to be in the guide position at step 511, since centering of the carriage 31 is not necessary. After the accumulated number M becomes higher than the predetermined value L, the line changing is carried out without centering the carriage 31, similar to the prior art.

As can be seen from the foregoing, according to the present invention, the carriage 31 is always brought to the sheet guide position prior to the change of line, until the front end 10*a* of the sheet 10 reaches the bail rollers 41, so that the sheet 10 can be guided by the sheet guide 55 provided on the carriage 31 without a paper jam occurring. Accordingly, according to the present invention, printing can be made even at the top end of the sheet 10 without producing a vacant space thereat.

We claim:

1. In a printer having a platen which rotates about its own axis to feed a sheet to be printed, a carriage is movable along an axis parallel to the platen and has a printing head and a sheet guide integral therewith to guide movement of the sheet toward the platen, said printer having bail rollers which hold the sheet against the platen when the sheet has moved a distance past the printing head, a method for changing a line of the sheet during printing, comprising:

setting the sheet in a print starting position in which a front edge of the sheet is located upstream of the bail rollers and supported against the platen only by the sheet guide;

printing when the sheet reaches the print starting position; and moving the carriage to a predetermined guide position in which the sheet guide is located at or near the center of the width of the sheet, prior to every line change until the front edge of the sheet is held between the bail rollers and the platen.

2. A method according to claim 1, wherein line changing is carried out without moving the carriage to the guide position only after the front edge of the sheet is held between the bail rollers and the platen.

3. A method according to claim 1, wherein said printer comprises a sensor located upstream of the printing head to detect the presence of the sheet when initially contacting the platen, and wherein said sheet is fed by a predetermined amount of rotation of the platen responsive to detection by said sensor.

4. In a printer having a platen which rotates about its own axis to feed a sheet to be printed, a carriage is movable along an axis parallel to the platen and has a printing head and a sheet guide integral therewith to guide movement of the sheet toward the platen, said printer having bail rollers which hold the sheet against the platen when the sheet has moved a distance past the printing head, an apparatus for changing a line of the sheet during printing, comprising:

means for setting the sheet in a print starting position, in which a front edge of the sheet is located upstream of the bail rollers and supported against the platen only by the sheet guide;

means for printing when the sheet reaches the sheet guide position; and means for moving the carriage to a predetermined guide position in which the sheet guide is located at or near the center of the width of the sheet, prior to every line change until the front edge of the sheet is held between the bail rollers and the platen.

5. A printer apparatus, comprising:

a platen which rotates about its own axis to feed a sheet to be printed; a carriage movable along an axis parallel to the platen;

a printing head;

a sheet guide integral to the print head to guide movement of the sheet toward the platen;

bail rollers which hold the sheet against the platen when the sheet has moved a distance past the printing head;

a sheet sensor which detects the presence of the sheet being in initial contact with the platen, said sheet being fed by a predetermined amount of platen rotation to a print starting position, responsive to detection by said sensor in which a front edge of the sheet is located upstream of the bail rollers and supported against the platen only by the sheet guide, in said printer apparatus for changing a line of the sheet during printing prior to the sheet being in contact with the bail rollers;

means for counting an accumulated number of lines responsive to detection by said sensor;

means for storing a set number of lines;

means for comparing the accumulated number and the set number;

means for storing a predetermined guide position of the carriage;

means for generating commands for a line print change;

determining means for determining whether movement of the carriage is necessary, responsive to the result of the comparison between the accumulated number and the set number, during said commands for a line print change;

means for moving the carriage with the sheet guide to a position corresponding to said predetermined guide position, in response to the determination by said determining means; and means for rotating the platen to feed the sheet by a predetermined amount of displacement according to one of, when the carriage is moved to the position corresponding to said predetermined guide position S and when movement of the carriage is determined not necessary by said determining means.

6. An apparatus according to claim 5, further comprising:

means for calculating a present position of the carriage; and means for comparing said predetermined guide position S and the present position of the carriage.

* * * * *